United States Patent [19]

Hyten et al.

[11] 4,195,778

[45] Apr. 1, 1980

[54] AUXILIARY AIR HEATER FOR FIREPLACES

[76] Inventors: Jesse G. Hyten, 1707 Denver, Portland, Tex. 78374; John I. Hyten, 204 N. Orbit, Del Rio, Tex. 78440

[21] Appl. No.: 851,714

[22] Filed: Nov. 15, 1977

[51] Int. Cl.[2] ..... F24H 3/02; F24D 5/02; F24B 7/04

[52] U.S. Cl. ..... 237/51; 126/121; 126/122; 126/165; 126/288; 236/11

[58] Field of Search ..... 126/121, 163, 164, 165, 126/122; 237/51, 50, 55; 236/11

[56] References Cited

U.S. PATENT DOCUMENTS

| | | | |
|---|---|---|---|
| 1,167,008 | 1/1916 | Murray | 126/122 |
| 1,415,345 | 5/1922 | Hatchett | 126/122 |
| 1,697,635 | 1/1929 | Cornelius | 126/121 |
| 2,077,599 | 4/1937 | Wales | 126/122 X |
| 2,165,661 | 7/1939 | Stenquist | 126/121 |
| 2,231,258 | 2/1941 | Elmore | 237/51 |
| 3,901,212 | 8/1975 | Stites | 126/121 |
| 4,006,729 | 2/1977 | Cesa | 126/121 |
| 4,043,313 | 8/1977 | Sherman | 126/121 |
| 4,049,194 | 9/1977 | Tice et al. | 126/121 |
| 4,059,090 | 11/1977 | Shaw | 126/121 |
| 4,064,864 | 12/1977 | Husa | 126/121 |

*Primary Examiner*—Allan D. Herrmann

[57] ABSTRACT

There is disclosed an air-to-air heat exchanger which is positioned in a fireplace. The heat exchanger comprises a grate structure on which logs are burned. Ambient air is circulated through the heat exchanger and is heated. Hot air exiting from the heat exchanger is delivered into a metal conduit extending vertically into the chimney. An opening is formed in the chimney wall in the attic of the building and hot air is delivered into ductwork in the building attic. A damper is provided in the fireplace which seals about the conduit extending vertically into the chimney in the closed position of the damper. Air flow through the conduit and heat exchanger may be reversed.

15 Claims, 6 Drawing Figures

AUXILIARY AIR HEATER FOR FIREPLACES

This invention relates generally to heating devices and more particularly to a heating system which extracts heat from a fireplace and distributes heated air into the ductwork of a building.

The heat generated in a fireplace is typically not utilized in an effective manner for room heating largely because much of the heat is discharged through the chimney in the form of hot combustion products and heated air. The heating that is actually accomplished by a fireplace occurs primarily because of the radiant heating of the area immediately to the front of the fireplace. Accordingly, fireplaces are normally provided merely for appearance and decorative effect while other heating systems are normally provided as the primary heating system of a building, such as a home.

A number of fireplace grate heat exchanger type structures have been devised for supporting burning fuel and providing air conveying tubes formed by the grate for receiving air from the room to be served by the fireplace. Air is passed through the tubes in adequate heat exchange relation with the burning fuel and is discharged into the room containing the fireplace to promote heating efficiency. Typical disclosures of the prior art of this type are found in U.S. Pat. Nos. 3,901,212; 3,939,496; 3,942,509; 3,955,553; 4,018,208 and 4,018,210. It is apparent that while fireplace heat exchangers of this type promote heating efficiency, they have the disadvantage of delivering heated air into the area that least requires it, which is immediately to the front of the fireplace. This area, of course, is normally much too warm and the delivery of hot air into this region largely aggravates this problem of conventional fireplaces even though heating efficiency is improved.

The concept of ducting heated air from a fireplace heat exchanger to an area other than immediately to the front of the fireplace is disclosed in U.S. Pat. No. 4,008,703. Although the broad suggestion is disclosed, the device and technique of this invention introduces a number of features which makes this concept practical particularly for incorporation in an existing residence where modifications are necessary to conduct heated air to other rooms.

In summary, this invention comprises a fireplace grate heat exchanger in which relatively cool air is forceably circulated through air passages in the heat exchanger. The heat exchanger is designed to provide a support for burning fuel. Air exiting from the heat exchanger passes into a flexible metal conduit which extends vertically into the chimney. Heated air passing into the flexible metal conduit is additionally heated by contact with hot air and combustion products moving upwardly through the chimney by convection. At the least, the temperature of the air in the flexible metal conduit does not begin to cool off until it moves out of the chimney.

Above the ceiling of the room in which the chimney is located, typically in an attic or crawl space, an opening is made into the interior of the chimney and a pipe connection is made to the flexible metal conduit for connecting it to suitable ductwork disposed in the attic for delivering hot air from a conventional air handling system to the various rooms of the building.

Reverse circulation of air through the heat exchanger may be accomplished merely by providing a fan capable of withstanding high temperatures and reversing the direction of fan operation.

It is accordingly an object of this invention to provide a heating system which more efficiently utilizes the heat produced within a fireplace in order to provide heat to rooms remote from the fireplace.

Other objects and a fuller understanding of the invention may be had by referring to the following description and claims taken in conjunction with the accompanying drawings.

IN THE DRAWINGS

Figure 1:
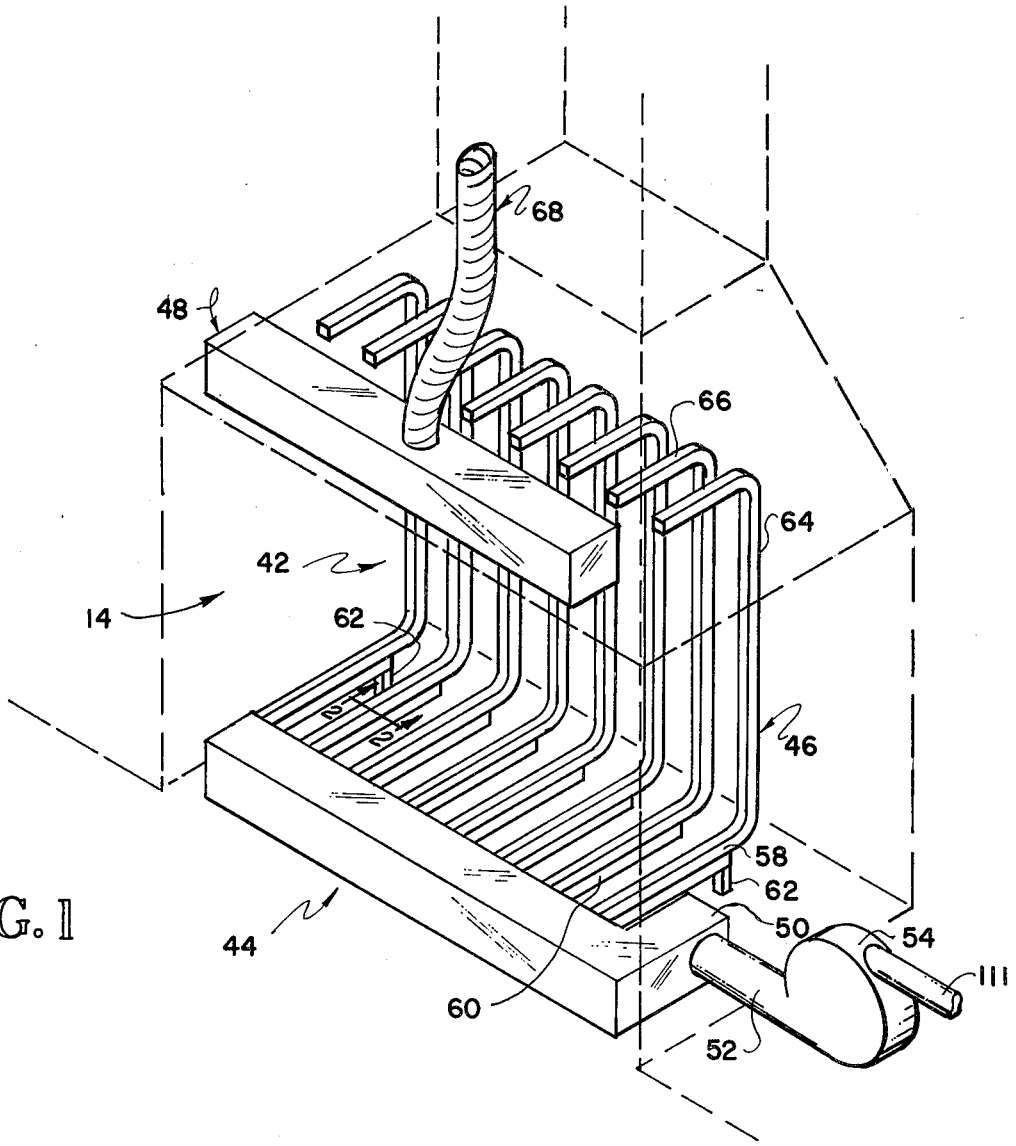
FIG. 1 is a front partially exploded isometric view of a fireplace heat exchanger of this invention illustrated in position in a fireplace shown in phantom lines.
Figure 2:
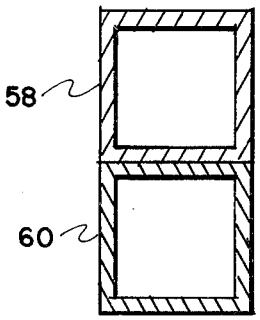
FIG. 2 is an enlarged cross-sectional view of the fireplace heat exchanger of FIG. 1 taken substantially along line 2—2 thereof as viewed in the direction indicated by the arrows.
Figure 3:
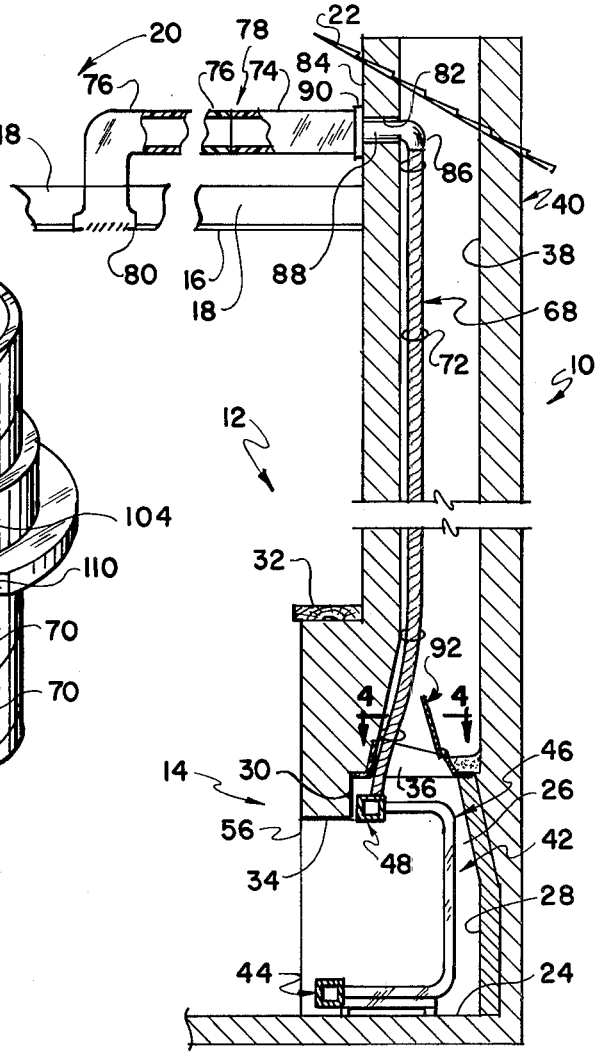
FIG. 3 is a vertical cross-sectional view of a fireplace equipped with the heat exchanger of this invention illustrating the delivery of heated air to ductwork in the attic of the building.

Referring to FIGS. 1 and 3, there is illustrated a building 10 such as a single family dwelling, apartment or other such structure comprising a room 12 having a fireplace 14 therein. The room 12 includes a ceiling 16 secured to joists 18 and separating the room 12 from an attic or crawl space 20 which is closed or covered by a roof 22.

The fireplace 14 is of more-or-less conventional design having a brick or firebrick floor 24, a pair of vertically extending sidewalls 26, a back wall 28 and a wall 30 covered by a suitable facade or decorative mantle 32. The fireplace 14 thus provides an opening 34 facing into the room 12 and a smoke exhaust opening 36 communicating with a passage 38 provided by a chimney 40 which is typically of brick.

Positioned in the fireplace 14 is an air-to-air heat exchanger 42 of this invention comprising, as major components, an air inlet manifold 44, a plurality of tubular sections 46 communicating with the manifold 44 and an air exhaust manifold 48.

The air inlet manifold 44 is conveniently made of generally square tubing providing an offset leg 50 conncted to the discharge conduit 52 of a fan or blower 54 which is desirably located in an enclosure immediately adjacent the fireplace 14. There are many situations where the fireplace 14 may be adjacent a wall so that the fan 54 may be located in an adjacent room or closet. If the location of the fireplace 14 is such that this is impractical, the fan 54 may be located forwardly of the front wall 56 of the fireplace 14 and the offset leg 50 repositioned.

The tubular sections 46 are conveniently of square or rectilinear configuration providing a first portion 58 which is shaped or positioned to provide a support for wood, coal or other solid fuel. The section 58 are accordingly desirably generally horizontal or downwardly inclined away from the manifold 44. To provide additional support for the solid fuel and to enhance heat exchange efficiency, a similar piece of square tubing 60 is welded onto the bottom of the horizontal portion 58. Suitable supporting legs 62 may be welded or otherwise secured to the tubing pieces 60 to support the heat exchanger 42.

The tubular sections 46 also comprise a generally vertically extending portion 64 and a generally horizontally extending portion 66 which overlies the portion 58 and which resides in the same vertical plane as the portion 58. The horizontal portions 66 terminate in suitable openings in the air exhaust manifold 48 which is desirably a piece of square tubing.

Connected to a single outlet opening in the exhaust manifold 48 is a conduit 68 which is generally parallel to the top wall 30 of the fireplace 14 and passes through the exhaust opening 36 into the chimney passage 38 to a location above the ceiling 16 and preferably above the joists 18. The conduit 68 is preferably made of a thermally conductive material. As used herein, a thermally conductive material is defined to mean a material which has a thermal conductivity value at least on the order of about that exhibited by common metals. The conduit 68 is desirably flexible to negotiate the inclined top wall 30 and the corner between the top wall 30 and the chimney passage 38. Accordingly, the conduit 68 may comprise a conventional flexible metal conduit including a multiplicity of substantially identical sections 70 which are relatively pivotable or articulatable. In the mode of operation of the invention where hot air is moving upwardly through the conduit 68, the existance of leaks in the conduit 68 is undesirable but not troublesome because the conduit 68 is pressurized above the pressure in the chimney 40. In this circumstance, any leakage will be out of the conduit 68 into the chimney 40 so that smoke or carbon monoxide does not enter the conduit 68.

As shown best in FIG. 3, the conduit 68 may be connected to a wall of the chimney 40 by suitable clamps 72. The upper end of the conduit 68 is connected to a duct 74 in the attic 20 of the building 10. The duct 74 is, in turn, connected to a duct 76 comprising part of an air handling system 78 which may be a central heating or central air conditioning system. The duct 76 normally branches off and extends to a plurality of rooms in the building 10 and terminates in one or more registers 80.

To connect the conduit 68 to the duct 74, an opening 82 is cut or broken through the chimney wall 84 to communicate between the attic 20 and the chimney passage 38. An elbow 86 is attached to the top of the conduit 68 which is in turn connected to a sleeve 88 carrying a flange 90 sealing against the chimney wall 84 around the periphery of the opening 82.

Typically located in the chimney passage 38 and normally adjacent the exhaust opening 36 is a damper structure 92 for controlling the rate of air flow vertically in the chimney 40. A typical damper construction includes a metal rim 94 affixed to the interior of the walls of the chimney 40 and a valve or damper plate 96 connected by a pivotal connection 98 to the rim 94. Suitable means (not shown) are provided for manipulating the damper plate 96 to move it between an open generally vertically extending position and a closed position engaging the rim 94.

In order to clear the conduit 68, a generally U-shaped slot 100 is cut, as by the use of an acetylene torch or the like, into the side of the damper plate 96 opposite from the pivotal connection 98. It will be apparent that the slot 100 will allow movement of the damper plate 96 between its normal open and closed positions.

In order to seal off the gap between the generally circular conduit 68 and the U-shaped slot 100, a fitting 102 is secured to the conduit 68. The fitting 102 comprises a collar 104 which may be affixed to the conduit 68 in any suitable manner, as by the provision of one or more set screws 106 or by welding, soldering, brazing or the like. Comprising part of the fitting 102 and integral with the collar 104 is a flange 108 which, in the embodiment illustrated, is of generally circular shape having a chord removed to leave a generally linear edge 110 which fits flush against the inner edge of the rim 94 to position the top of the flange 108 generally coplanar with the top of the rim 94. The damper plate 96 accordingly engages the rim 94 and flange 108 in the closed position to prevent upward air movement through the chimney 40. It will be apparent that the flange 108 may be further trimmed to more closely correspond to the shape of the slot 100 to thereby minimize the restriction to air passing through the passage 38.

It will be evident that the fireplace heat exchanger 42 may be used merely as a grate for burning solid fuel merely by leaving the fan 54 unenergized. When it is desired to deliver heated air through the heat exchanger 42 to another room of the building 10, the fan 54 is energized to pass relatively cool air into the inlet manifold 44, through the tubular sections 46, through the exhaust manifold 48 and then through the conduit 68 for delivery into the ductwork 74, 76. As will become more fully apparent hereinafter, the temperature of the air entering the duct 74 is quite high. It will accordingly be desirable to operate the fan (not shown) of the air handling system 78 in order to mix the hot air from the conduit 68 with ambient interior air.

In addition to providing a very convenient means for ducting heated air away from the fireplace 14, the positioning of the metal conduit 68 in the chimney has an additional heat exchanging advantage. It will be evident that the temperature of the air and combustion products in the region where the conduit 68 is located is quite high. Thus, at the very minimum, there will be little or no cooling off of the heated air in the conduit 68 during air passage from the exhaust manifold 48 to the sleeve 88. Indications are that it is more likely that the air traveling through the conduit 68 is heated still further during vertical movement into the duct 74. In a test situation where a very intense fire was ignited on the heat exchanger 42, temperature measurements indicated that the air temperature in the conduit 68 immediately above the manifold 48 was 412° F. while the temperature of air exhausting from the conduit 68 was 414° F. The exact hot air temperatures will depend, of course, on factors such as the rate of air movement through the heat exchanger 42, the type and quantity of fuel being burned, the efficiency of heat conductance through the tubular sections 46 and the like.

As heretofore described, the direction of air flow is such that heated air passes upwardly through the conduit 68. It will be evident, however, that air flow may, in the alternative, be downwardly through the conduit 68 with minor modifications. The fan 54 need only be capable of withstanding relatively high temperatures and be driven so that relatively high pressure air is discharged through a conduit 111 either into the room 12 or into another room. In this circumstance, air is drawn through the registers 80 connected to the duct 76 and passes downwardly through the conduit 68 into the manifold 48, through the tubular sections 46 and into the manifold 44. In this event, it will be evident that the air to be heated in the heat exchanger 42 is pre-heated in the conduit 68. From a purely thermal efficiency standpoint, this mode of operation is preferable because the heat exchange relation of the air in the conduit 68 and the air passing upwardly in the chimney 40 is in a countercurrent relationship. It is, of course, well known that countercurrent heat exchangers are more efficient than heat exchangers in which the hot and cold fluids are passing in the same direction.

Although the fan 54 may be capable of withstanding only low temperatures and positioned in the attic 20, it is preferred that the fan 54 be selected to withstand relatively high temperatures and be of a reversible nature so that it can be driven in either direction so that the heat exchanger 42 has two modes of operation.

During installation, it is desirable to wrap the duct 74 with a suitable heat insulating material, such as asbestos, to prevent the exterior temperature of the duct 74 from getting too high and causing a fire hazard. In addition, it is desirable to place a flapper or check valve (not shown) in the duct 74 or sleeve 88 to prevent reverse air circulation through the heat exchanger 42 during the summer when the air handling equipment 78 may be used for cooling.

Figure 6:
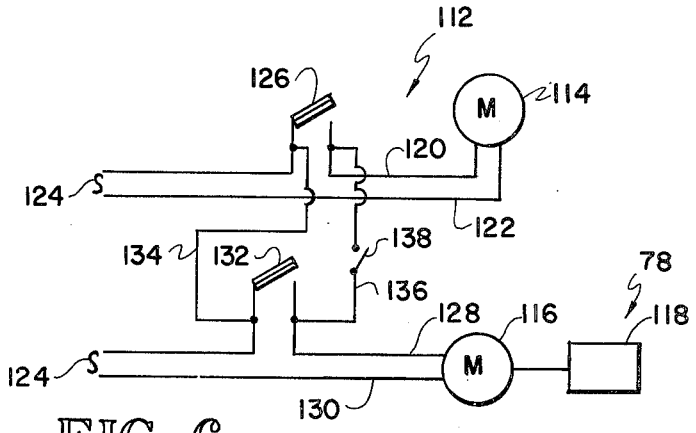
FIG. 6 is a schematic view of an electrical system for energizing the air moving equipment associated with the invention.
Figure 4:
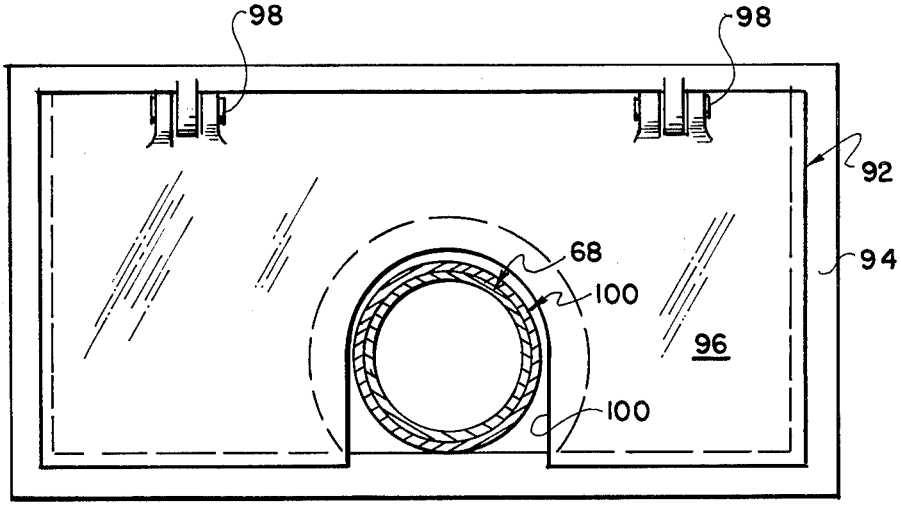
FIG. 4 is an enlarged cross-sectional view of the fireplace installation of FIG. 3 taken substantially along line 4—4 thereof as viewed in the direction indicated by the arrows illustrating the fireplace damper in a closed position about the vertical conduit.
Figure 5:
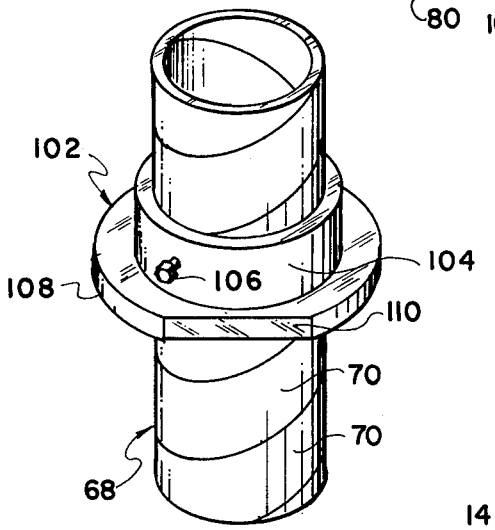
FIG. 5 is an isometric view of the conduit and seating surface which cooperate with the damper to provide a substantially air-tight seal in the closed position of the damper.

Referring to FIG. 6, there is illustrated an electric circuit 112 for selectively energizing a motor 114 driving the fan 54 and for selectively energizing a motor 116 driving a fan 118 of the air handling equipment 78. The circuit 112 includes a pair of leads 120, 122 connecting the motor 114 to a source of power 124. A controllable thermostat such as a bimetal switch 126 is disposed in the lead 120 for energizing the fan motor 114 in response to the occurrence of a preselected or changeable low temperature sensing in the room where the switch 126 is located. Accordingly, circulation of air through the heat exchanger 42 may be in response to the cooling off of a room remote from the fireplace 14.

The circuit 112 also includes a pair of leads 128, 130 connecting the motor 116 to the source of power 124. A thermostat such as a bimetal switch 132 is disposed in the lead 128 for energizing the fan motor 116 in response to the occurrence of a preselected or changeable temperature sensing occurring in the room where the switch 132 is located. The leads 128, 130 and switch 132 will be recognized as part of a conventional central heating and/or cooling system comprising the air handling equipment 78.

In addition, the subcircuit energizing the fan motor 114 may be interconnected with the subcircuit energizing the fan motor 116 for automatically mixing heated air from the heat exchanger 42 and ambient interior air. To this end, the circuit 112 may comprise a lead 134 connecting one leg of the switches 126, 132 together and a lead 136 having a switch 138 therein connecting the other leg of the switches 126, 132 together. With the switch 138 closed, at any time either of the thermostatic switches 126, 132 senses a preselected low temperature, both of the fan motors 114, 116 will be energized to deliver a mixture of heated and ambient interior air through the registers 80. When the switch 138 open, the fan motors 114, 116 operate independently to deliver heated air from the heat exchanger 42, to deliver heated air from the air handling system 78 or to deliver cool air from the air handling system depending on the selected mode of operation of the system 78.

It will be apparent that the system of this invention is adapted for incorporation in new building construction and is particularly desirable for modifying an existing structure to increase heating efficiency.

Although the invention has been described in its preferred form with a certain degree of particularity, it is understood that the present disclosure of the preferred form has been made only by way of example and numerous changes in the details of construction and combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

I claim:

1. In a building including a room having a fireplace opening thereinto and a ceiling, a chimney communicating with the fireplace providing an exit for hot combustion products and extending vertically above the ceiling, and an air handling system including ductwork above the ceiling, the combination comprising a heat exchanger in the fireplace providing a plurality of tubular sections of thermally conductive material for receiving heat from the fireplace, means providing a first air opening to the tubular sections, a manifold providing a second air opening to the tubular sections, and a conduit connected to the manifold, the conduit extending vertically in the chimney to a location above the ceiling;

means extending through the chimney providing communication between the ductwork and the conduit for interchanging air between the conduit and ductwork; and a damper and means mounting the damper inside the chimney for controlling the rate of air flow vertically through the chimney, the damper and conduit cooperating to provide a closure of the annulus between the chimney and the conduit in the closed position of the damper.

2. The building of claim 1 wherein the conduit is of thermally conductive material.

3. The building of claim 2 wherein the thermally conductive material is metal.

4. The building of claim 3 wherein the conduit is of the flexible type comprising a multiplicity of articulated metal sections.

5. The building of claim 1 wherein the means providing the first air opening to the tubular sections includes a manifold communicating with each of the tubular sections and provides the first opening, and further comprising a fan having an inlet and an outlet and means connecting one of the inlet and outlet to the first opening.

6. The building of claim 5 wherein the fan comprises a motor drivable in opposite directions for delivering air in opposite directions, the fan being capable of withstanding temperatures in excess of 400° F.

7. The building of claim 5 wherein the fan outlet is connected to the first opening.

8. The building of claim 1 wherein the means providing the first air opening to the tubular sections includes a manifold communicating with each of the tubular sections and provides the first opening, the tubular sections each including a first portion providing the support and a second vertically extending portion communicating between the first portions and the manifold.

9. The building of claim 8 wherein the tubular sections each further includes a third portion overlying the first portion providing communication between the second portion and the manifold.

10. The building of claim 1 wherein the heat exchanger is arranged to provide a support for solid fuel.

11. The building of claim 1 wherein the chimney describes, in horizontal cross-section, a regular polygonal opening and the conduit occupies part of the opening, the damper being configured to pass the conduit during movement toward the closed position of the damper.

12. The building of claim 11 wherein the damper includes a plate having a slot opening through one side thereof and the mounting means comprises a pivot connection securing an opposite side of the damper to the chimney.

13. The building of claim 12 further comprising a collar secured to the conduit having a flange thereon engaging the damper in the closed position thereof, the flange substantially sealing between the damper slot and the conduit.

14. In a building including a first room having a fireplace opening thereinto, a second room, and a ceiling, a chimney communicating with the fireplace providing an exit for hot combustion products and extending vertically above the ceiling, and an air handling system including ductwork above the ceiling leading to a second room, the combination comprising a heat exchanger in the fireplace providing a plurality of tubular sections of thermally conductive material for receiving heat from the fireplace, means providing a first air opening to the tubular sections, a manifold providing a second air opening to the tubular sections, and a conduit connected to the manifold, the conduit extending vertically inside the chimney to a location above the ceiling;

means extending through the chimney providing communication between the ductwork and the conduit for interchanging air between the conduit and ductwork;

a first fan having an inlet and an outlet, means connecting one of the inlet and outlet to the first opening, and a first electric motor for driving the first fan;

a first circuit for energizing the first fan motor including a first pair of leads connected to the first motor and a first thermostatically operated switch, located in the second room of the building, in one of the first leads for energizing the first fan motor upon occurrence of a preselected low temperature in the second room; and the air handling system includes a second fan driven by a second electric motor for circulating ambient air through the ductwork and a second circuit for energizing the second electric motor including a pair of second leads connected to the second electric motor and a second thermostatically operated switch in one of the second leads for energizing the second fan motor upon the occurrence of a preselected low temperature adjacent the second thermostatically control switch and means connecting the first and second circuits for simultaneously energizing the first and second fan motors in response to the actuation of either of the thermostatically operated switches.

15. The building of claim 14 wherein the connecting means includes means for deactivating the connecting means and allowing the thermostatically operated switches to independently control the first and second fan motors.

* * * * *